United States Patent [19]

Eckert

[11] 4,084,562

[45] Apr. 18, 1978

[54] FUEL METERING DEVICE

[75] Inventor: Konrad Eckert, Stuttgart-Feuerbach, Germany

[73] Assignee: Robert Bosch GmbH, Stuttgart, Germany

[21] Appl. No.: 596,261

[22] Filed: Jul. 16, 1975

Related U.S. Application Data

[63] Continuation-in-part of Ser. No. 365,633, May 31, 1973, abandoned.

[30] Foreign Application Priority Data

Aug. 8, 1972 Germany ..... 2238990

[51] Int. Cl.[2] ..... F02M 7/00; F02M 13/04; F02H 5/02

[52] U.S. Cl. ..... 123/119 EC

[58] Field of Search ..... 123/119 R, 32 EA, 119 EE, 123/32 EE; 261/50 A

[56] References Cited

U.S. PATENT DOCUMENTS

| | | | |
|---|---|---|---|
| 806,822 | 12/1905 | Millard | 261/69 R |
| 1,444,222 | 2/1923 | Trego | 261/69 R |
| 1,740,282 | 12/1929 | Carter | 261/69 R |
| 2,040,778 | 5/1936 | Morgan | 123/32 EE |
| 2,187,885 | 1/1940 | Markham | 261/41 |
| 2,220,558 | 11/1940 | van Dijek et al. | 123/119 E |
| 3,005,625 | 10/1961 | Holley, Jr. | 261/23 |
| 3,343,820 | 9/1967 | Elliott | 261/23 |
| 3,409,277 | 11/1968 | Reise | 261/51 |
| 3,464,008 | 8/1969 | Meysson et al. | 204/195 |
| 3,493,217 | 2/1970 | Farley | 261/39 R |
| 3,588,058 | 6/1971 | Lucas | 261/69 |
| 3,620,196 | 11/1971 | Wessel | 123/32 EA |
| 3,673,989 | 7/1972 | Aono | 123/32 EA |
| 3,685,502 | 8/1972 | Oberjorfer, Jr. | 123/119 R |
| 3,689,036 | 9/1972 | Kikuchi et al. | 261/34 A |
| 3,738,341 | 6/1973 | Loos | 123/119 EE |
| 3,758,084 | 9/1973 | Tuckey | 261/69 A |
| 3,764,120 | 10/1973 | Imai | 261/39 B |
| 3,782,347 | 1/1974 | Schmidt et al. | 123/119 R |
| 3,795,387 | 3/1974 | Hebert | 261/69 R |

FOREIGN PATENT DOCUMENTS

| | | | |
|---|---|---|---|
| 1,337,284 | 8/1963 | France | 261/67 |

*Primary Examiner*—Wendell E. Burns
*Attorney, Agent, or Firm*—Edwin E. Greigg

[57] ABSTRACT

A fuel metering device for low fuel feed pressures is described which is adapted for use in an externally ignited internal combustion engine of the air/fuel mixture-compressing type having an air-intake suction tube, and which comprises (a) conduit means for conveying fuel to the suction tube of the engine, (b) throttle means of determinable cross-sectional throttle area disposed in the conduit means, (c) bypass duct means for bypassing the throttle means, and (d) control means for switching the bypass means into the fuel flow through the conduit means to bypass the aforesaid throttle means, thereby varying the ratio of the amounts of fuel and air in the mixture being formed in the suction pipe; the control means are responsive to characteristic engine data.

9 Claims, 4 Drawing Figures

FUEL METERING DEVICE

CROSS-REFERENCE TO RELATED APPLICATION

This is a continuation-in-part application of application Ser. No. 365,633, filed on May 31, 1973, now abandoned.

BACKGROUND OF THE INVENTION

This invention relates to a fuel metering device for low fuel feed pressures and adapted for use in externally ignited internal combustion engines of the air/fuel mixture-compressing type with conduit means for conveying fuel to the suction pipe of the engine, in which conduit means at least one throttle passage of determinable cross-sectional area is arranged.

In an internal combustion engine, such a fuel metering device serves for attaining, automatically and under all operational conditions, a favorable fuel/air mixture ratio, in order to burn the fuel as completely as possible and thereby to avoid or substantially reduce the production of toxic exhaust gases while maintaining an optimal performance of the internal combustion engine with the smallest possible consumption of fuel. To this end, it is necessary that, when starting a cold engine, the fuel/air mixture is "richer" during the warming-up phase, i.e., the fuel portion in the mixture must be larger, than when the engine is warm. However, even in a hot engine it is necessary to meter the fuel in amounts corresponding very accurately to the requirements of every operating condition of the internal combustion engine. Therefore, the proportionality of the amounts of air and fuel in the mixture must be variable, in dependence on such engine data as speed, load, and temperature, as well as on environmental data such as air humidity, atmospheric pressure, and ambient temperature.

In the case of a known fuel metering device of the initially described type, complicated control systems must be provided to meet the above-stated requirements.

OBJECT AND SUMMARY OF THE INVENTION

It is an object of the invention to provide a fuel metering device in which the actual value of the fuel/air mixture is continually measured, and the desired value can be varied by very simple means, in particular by making use of all the possibilities of electrical control.

This object is achieved according to the invention, by providing a fuel metering device of the type described initially, wherein the conduit means which convey fuel to the suction tube serving as air-intake means of the engine, has at least one by-pass duct, by-passing the throttle means provided in the conduit means, which by-pass duct can be switched into the fuel conduit means; such switch-in takes place as a function of engine data, whereby the fuel/air ratio is rendered variable. The switch-in can be effected by electrically operating means, and may occur in the sense of an intermittent cyclic process whose cycle frequency may correspond to the suction frequency of the engine. In order to ensure a better control of the amount of fuel flowing through the by-pass duct, a throttle of determinable cross-section may also be arranged in the bypass duct.

The invention will be better understood and further objects and advantages will become apparent from the ensuing detailed specification of preferred but merely exemplary embodiments taken in conjunction with the drawings.

DESCRIPTION AND OPERATION OF THE EMBODIMENTS

Figure 1:
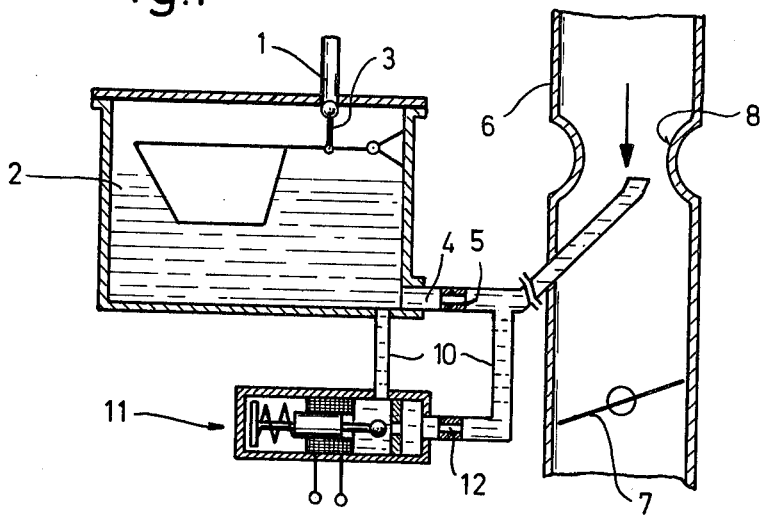
FIG. 1 shows a first embodiment of the fuel metering device according to the invention in which the air measurement is carried out by means of a Venturi.

The fuel is conveyed by means of a fuel prefeed pump (not shown) via a conduit 1 to a float tank 2, wherein the discharge opening of conduit 1 is controlled by means of a float-actuated ball valve 3. From the float tank 2, the fuel flows into the suction pipe 6 via a conduit 4 in which there is provided a throttle passage 5. A throttle valve 7 which can be adjusted as desired, and an air-flow measuring member (not shown) are successively arranged in the direction of air flow in suction pipe 6.

The conduit 4 is provided with a by-pass duct 10 which circumvents the throttle passage 5 and is controlled by a solenoid valve 11. The solenoid valve 11 is open when deenergized, however, it is also possible to use a valve which is closed when deenergized. A throttle passage 12 is disposed in the by-pass duct 10 downstream of the solenoid valve 11. To the metered amount of fuel whose flow is influenced by the throttle passage 5 and which can be determined by means of the pressure conditions in the suction pipe, there is fed an additional fuel amount which is controlled by an electrical control means in the form of the solenoid valve 11 and the flow of which is influenced by the throttle passage 12; such additional fuel supply occurs always, when the measured values of the engine data (e.g., of an oxygen detector electrode in the exhaust gas) cause a switch-in of the by-pass duct 10. Control and any resulting adjustment are preferably achieved by means of an electronic control device (not shown). Although the oxygen detector electrode is not shown an the electronic control device is only shown schematically by the reference numeral 18, they are nevertheless known in the art. For example, the oxygen detector electrode can be similar to that disclosed in either U.S. Pat. No. 3,464,008 or U.S. Pat. No. 3,738,341; and the electronic control device can be similar to that disclosed in U.S. Pat. No. 3,620,196.

Figure 2:
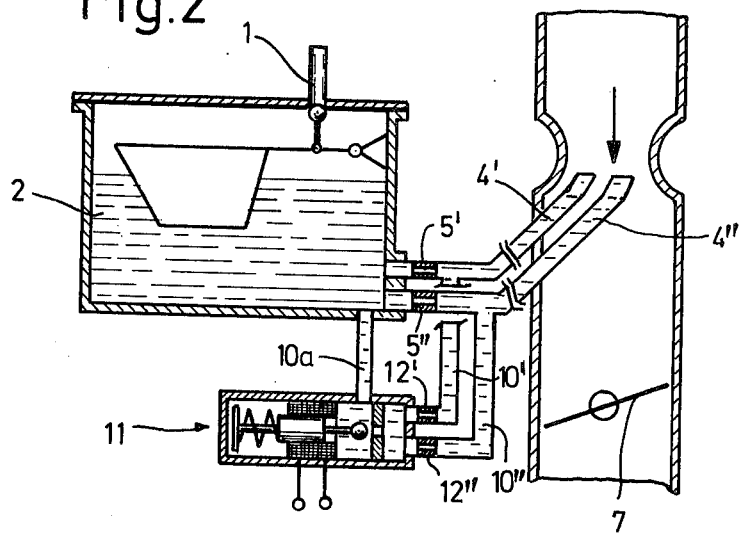
FIG. 2 shows another embodiment of a fuel metering device, similar to that shown in FIG. 1 in which two conduits serve as fuel conveying means.

Whereas only one fuel feed line 4 is provided in the embodiment shown in FIG. 1, the embodiment shown in FIG. 2 has two such fuel feed lines 4' and 4''. Accordingly, two throttle passages 5' and 5'' are also provided in the respective feed lines. The by-pass ducts 10' and 10'' are controlled in common by a single solenoid valve 11, but they have each a throttle passage 12' and 12'' respectively, and share the fuel admitted to valve 11 from float tank 2 via a common conduit **10*a***.

Figure 3:
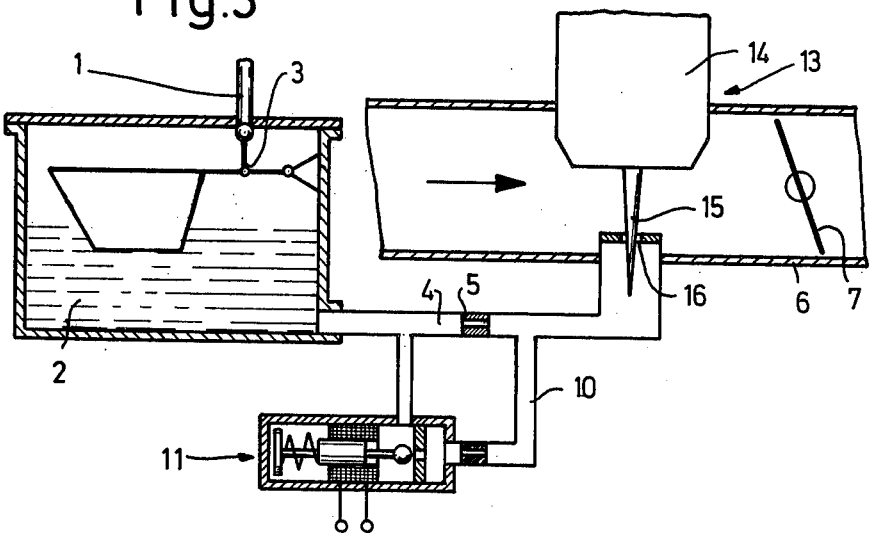
FIG. 3 shows yet another embodiment which is controlled by means of a Stromberg measuring member.

Into the embodiment shown in FIG. 3, the air amount flowing through the suction pipe 6 is measured by means of a Stromberg measuring member 13 which comprises a needle 15 rigidly mounted on a metering piston 14 and which controls the cross-sectional area of a fuel metering nozzle 16.

Figure 4:
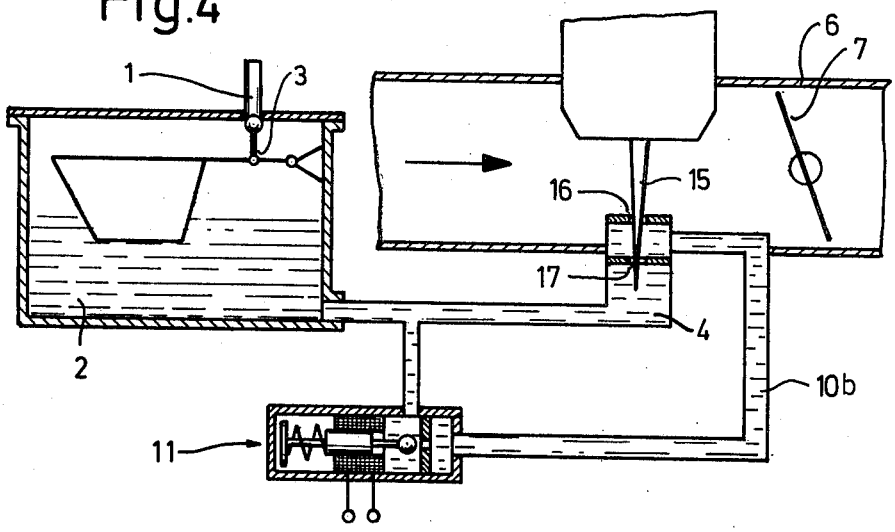
FIG. 4 shows a further embodiment, similar to that shown in FIG. 3, in which two simultaneously controlled throttles are arranged in the main conduit for correcting non-linear fluctuations of the air/fuel ratio.

In the embodiment shown in FIG. 4, needle 15 controls additionally the diameter of a throttle bore 17 which is interposed upstream of nozzle opening 16 in fuel feed line 4. In this embodiment, by-pass duct 10*b* discharges into fuel feed line 4 in a zone thereof between the two control points at 16 and 17. A complete compensation of non-linear fluctuations between the amount of air flowing through the suction pipe and the fuel amount to be added, is achieved by thus controlling the diameter of throttle bore 17 as a function of the diameter of nozzle opening 16.

What is claimed is:

1. A fuel metering device for low fuel feed pressures and adapted for use in an externally ignited internal combustion engine of the air/fuel mixture-compressing type, having an air-intake suction tube, which device comprises:

(a) conduit means for conveying fuel to the said suction tube of the engine, (b) throttle means of determinable cross-sectional throttle area disposed in said conduit means, (c) bypass duct means for bypassing said throttle means, and (d) electrical control means responsive to characteristic engine data for switching said bypass means into the fuel flow through said conduit means to bypass said throttle means, thereby varying the ratio of the amounts of fuel and air in the mixture being formed in said suction pipe, wherein said electrical control means is adapted to a work cycle and switches in said bypass means intermittently in dependence on the work cycle, the frequency of which corresponds to the suction frequency of the engine.

2. A fuel metering device as described in claim 1, wherein said bypass means comprise at least one bypass duct containing a throttle passage.

3. A fuel metering device as described in claim 1, wherein said electric control means comprise a solenoid valve.

4. A fuel metering device as described in claim 3, wherein said solenoid valve is in open position when de-energized.

5. A fuel metering device as described in claim 1, wherein said conduit means comprise two conduits adapted for connection to the suction pipe of the engine, wherein said bypass means includes two conduits each connected to a respective one of the conduits of said conduit means and to said electrical control means, wherein said throttle means comprise a throttle passage in each of the conduits of said conduit means, and wherein said electrical control means comprises a single valve controlling said two conduits of said conduit means in common via two conduits of said bypass means.

6. A fuel metering device as described in claim 1, further comprising fuel metering nozzle means disposed in said conduit means downstream of said throttle means where said bypass duct means reunite with said conduit means.

7. A fuel metering device as described in claim 6, further comprising nozzle control means associated with said fuel metering nozzle means.

8. A fuel metering device as described in claim 7, wherein said nozzle control means are of the Stromberg type and comprise a valve needle controlling the internal cross-sectional area of said nozzle means.

9. A fuel metering device as described in claim 7, wherein said throttle means of said conduit means are located in the latter in a position where the cross-sectional area of the throttle passage thereof can be controlled by said nozzle control means together with the internal cross-sectional area of said nozzle means.

* * * * *